United States Patent [19]

Kyrazis

[11] Patent Number: 4,743,364

[45] Date of Patent: May 10, 1988

[54] MAGNETIC SEPARATION OF ELECTRICALLY CONDUCTING PARTICLES FROM NON-CONDUCTING MATERIAL

[76] Inventor: Demos T. Kyrazis, 1708 Chacoma Pl., SW., Albuquerque, N. Mex. 87104

[21] Appl. No.: 590,183

[22] Filed: Mar. 16, 1984

[51] Int. Cl.[4] ..... B03C 1/00; B03C 1/22

[52] U.S. Cl. ..... 209/212; 209/214; 209/216; 209/227

[58] Field of Search ..... 209/212–216, 209/223 R, 223 A, 232, 224, 227; 335/234, 222

[56] References Cited

U.S. PATENT DOCUMENTS

| | | | |
|---|---|---|---|
| 3,279,602 | 10/1966 | Kottenstette et al. | 209/214 |
| 3,289,836 | 12/1966 | Weston | 209/214 |
| 3,294,237 | 12/1966 | Weston | 209/232 |
| 3,382,977 | 5/1968 | Fraas | 209/214 |
| 3,448,857 | 6/1969 | Benson et al. | 209/212 |
| 3,552,564 | 1/1971 | Burgener | 209/214 |
| 3,595,386 | 7/1971 | Hradel | 209/214 |
| 3,608,718 | 9/1971 | Aubrey | 209/214 |
| 3,824,516 | 7/1974 | Benowitz | 209/212 |
| 4,017,385 | 4/1977 | Morton et al. | 209/223 R |
| 4,238,323 | 12/1980 | Zakharov | 209/212 |
| 4,416,771 | 11/1983 | Henriques | 209/232 |

FOREIGN PATENT DOCUMENTS

| | | | |
|---|---|---|---|
| 2059166 | 6/1972 | Fed. Rep. of Germany | 209/223.1 |
| 74169 | 6/1977 | Japan | 209/232 |
| 700205 | 11/1979 | U.S.S.R. | 209/223.1 |

*Primary Examiner*—Kenneth M. Schor

*Attorney, Agent, or Firm*—Poms, Smith, Lande & Rose

[57] ABSTRACT

A magnetic process and apparatus for separating out small electrically conductive particles dispersed in a finely ground, relatively non-conductive medium by means of magnetic fields. More specifically, a steady or relatively slowly varying field is provided, and a higher frequency magnetic field induces magnetic dipoles into the conducting particles, which are displaced by the steady magnetic field to thereby effect separation. The magnetic separation process selectively applies a force on a conductive particle so as to either remove it from the bulk of the non-conductive material or increase the concentration of conductive particles in a given volume of space. The effectiveness of the separation process improves with increasing size of the particle; however, the process can be used for particle sizes that would be classed as "very fine".

19 Claims, 3 Drawing Sheets

MAGNETIC SEPARATION OF ELECTRICALLY CONDUCTING PARTICLES FROM NON-CONDUCTING MATERIAL

BACKGROUND OF THE INVENTION

It is well known that magnetic fields can selectively exert forces on non-ferromagnetic substances by taking advantage of physical interactions of the magnetic field with matter. Prior arrangements have used either (1) a significant difference in magnetic susceptibility, or (2) "Eddy Current" principles. Using these forces, separators can be constructed to separate electrically conductive materials from non-conducting materials. The first of these types of separator is referred to as a gradient separator. Gradient separators are used to separate weakly magnetic substances from other substances especially where the weakly magnetic substances have large magnetic susceptibilities, $X_m$, relative to the other substances. In the presence of a magnetic field, B, a magnetic dipole moment is induced in the magnetic substance. The magnitude of the dipole moment is proportional to the product of the susceptibility and the field, viz. $X_m \cdot B$. The force on the particle is a function of the product of the magnetic moment and the gradient of the magnetic field, $$F \sim X_m B \cdot \nabla B$$

In recent years, high intensity, high gradient magnetic separators have been developed. Field intensities of 1–2 Tesla and gradients of $10^5$ Tesla/meter have been obtained in commercial applications for example, by filling the working volume with a fine, ferritic stainless steel wool. The particles are attracted to and bound to the steel wool while the magnetic field is on. The particles are flushed out of the apparatus after the magnetic field is turned off. In most cases the gradient type separator is used to remove impurities from a host material. Laboratory scale experiments on clear channel, continuous flow processes have also been reported in which very high magnetic and gradient fields have been produced by using super-conducting magnets. However, this is an extremely costly and cumbersome process which is not economical in many uses.

A second type of separator is referred to as an eddy current separator. This method and apparatus takes advantage of the fact that time varying magnetic fields induce currents in conductors and the magnetic field can exert forces on these induced currents. The time variation in the magnetic field can be caused by an explicit change in the magnitude of the field or by relative motion between the conductor and the field.

Several types of eddy current devices are known in the art. Representative of a device that depends on the explicit time variation of the magnetic field is a coil through which a capacitor is discharged. The resulting time varying magnetic field accelerates a conductor away from the coil. Some of the disadvantages of this method are that the induced currents ultimately approach zero. As a result, the size of the conductor has to be relatively large (e.g. millimeters). Also, it is relatively difficult to repetitively accelerate the conducting particle whereby repeatable operations are not easily achieved. Perhaps most troublesome, attempts to take advantage of the relative motion between the conductor and the magnetic field lead to prohibitively large relative velocities especially when applied to conductors on the order of tens of microns in size.

PRIOR ART STATEMENT

The most pertinent prior art known to the inventor is listed herewith.

U.S. Pat. No. 4,031,004 to E. J. Sommer, Jr., et al. This patent is directed to a feed system for use with an electromagnetic eddy current materials separator.

U.S. Pat. No. 4,069,145 to E. J. Sommer, Jr., et al. This patent is directed to an electromagnetic eddy current materials separator for separating particles of different electrical conductivity.

U.S. Pat. No. 4,238,323 to M. S. Zalcharova, et al. This patent is directed to the electrodynamic separation of nonmagnetic materials by passing same through a region of maximum intensity of a variable, nonuniform magnetic field to produce maximum eddy currents therein.

However, these patents do not describe an independent control of the magnetic fields.

U.S. Pat. No. 4,277,329 to Cavanaugh. This patent is directed to a separator system using angularly oriented magnetic devices to make the magnetic fields.

U.S. Pat. No. 3,693,792 to Lang. This patent is directed to an electrodynamic particle separator using a magnetic flux rotating at high velocity.

U.S. Pat. No. 3,448,857 to Benson et al. This patent is directed to a magnetic separator using a repulsion type principle.

SUMMARY OF THE INVENTION

A magnetic separator device and method utilize a suitable structure to establish a slowly varying or steady gradient field $B_s$, at a work station or region. The steady magnetic field is formed typically by a ferromagnetic structure. The source of the field, $B_s$ can be a permanent magnet, an electromagnet, or a superconducting magnet. Also, a time varying field, $B_i$, is generated at the work station, for example, by coils at or near the ferromagnetic structure. The coils are driven by a suitable varying voltage, v(t). A flow of material consisting of a mixture of conducting and nonconducting particles enters the apparatus and is subjected to the magnetic fields within the apparatus whereby the conducting particles are magnetically deflected and separated from the non-conducting particles.

In accordance with another feature of the invention, the flow of material to be separated may be synchronized with the varying magnetic field, to increase the separation.

Other objects, features, and advantages will become apparent from a consideration of the following detailed description and from the accompanying drawings.

DETAILED DESCRIPTION

Figure 1:
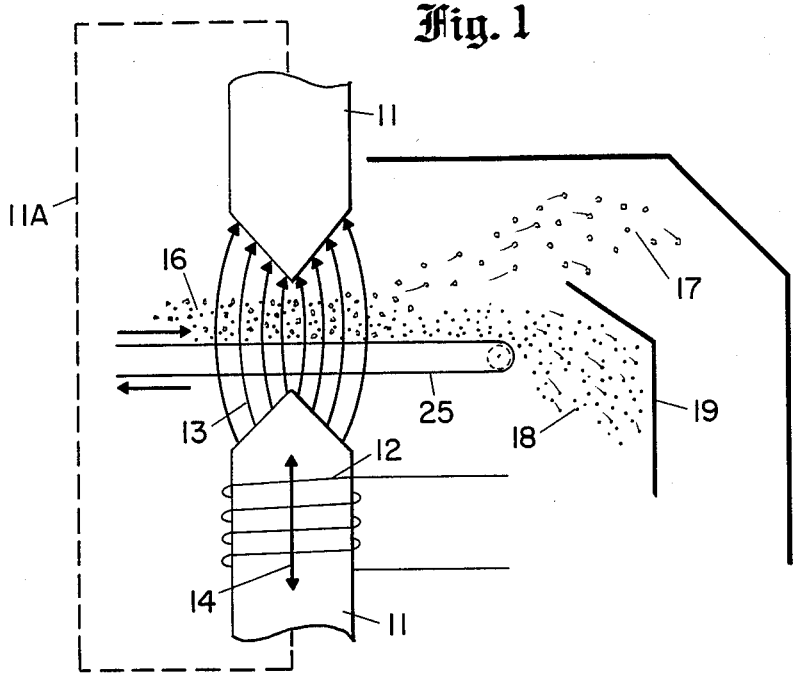
FIG. 1 is a schematic representation of the basic magnetic separator illustrating the principles of the invention.

Referring now to FIG. 1, there is shown a schematic representation of a magnetic separator apparatus which implements the principles of the invention.

In particular, the separator includes a suitable structure for establishing appropriate magnetic fields at a work station 10. The structure includes a magnetic structure 11 which is schematically represented by two magnetic poles 11 which are opposed to each other across a space defined as work station 10. For convenience, the entire closed magnetic structure is not disclosed in this figure but is representated by the dashed line 11A. An additional magnetic structure is included within the additional magnetic structure 11. The magnetic structure which can be a permanent magnet, electromagnet, or super-conducting magnet, is utilized to establish a steady gradient field $B_s$ at the work station 10. This gradient field is a steady but may be a highly non-uniform field.

A coil 12 is used with the magnetic structure 11 to produce a time varying field $B_i$. Typically, the coil (or coils) is wound around one of the poles 11. The field is created by the coil 12 which is coupled to an alternating current driving source 21 which supplies a drive signal V(t).

The magnetic structure, therefore, produces a total magnetic field $B_t = B_s + B_i$ which field is produced between the poles 11 in the work space 10.

In operation, a flow or stream of mixture 16 is supplied to the work station by a suitable conveyor means 25 or the like. The mixture may be in the form of particulates, a slurry or other appropriate combination of materials. In particular, the combination includes both conductive and non-conductive materials, elements, particles or the like. After the mixture 16 has been subjected to the total magnetic field $B_t$ produced by the apparatus to work station 10, the conductive and non-conductive particles are separated. In the example shown, the conducting particles 17 are displaced upwardly from the non-conductive particles 18. A barrier 19 keeps the particles from becoming mixed again. When the particles have been separated, as shown, a suitable receptacle or bin (not shown) can be used to receive each of the types of materials.

In considering the operation of the structure or apparatus shown in FIG. 1, it may be noted that there are certain aspects which are involved in the improved magnetic separation process for conductive particles. These aspects include (1) independent control of the time varying and the gradient fields, (2) the application of periodic forces on the particles, (3) the average value of the time varying current which produces the time varying magnetic field is zero but may be asymetrically applied over a time period, (4) the relative motion between the conducting particles and the steady magnetic field may be utilized to provide a unidirectional force on the particles.

It should be understood that these aspects are features of the invention and can be incorporated either individually or together depending upon the chosen application, the size of the conducting particles, the production rates required for separation and so forth.

In discussing the magnetic fields established by the structure, it is understood that a time varying field $B_i$ and a steady magnetic field $B_s$ are provided. Time varying field $B_i$ is primarily used to induce a magnetic dipole moment in a conductor particle. The steady magnetic field $B_s$ is used primarily to provide a high field gradient which exerts an accelerating force on the induced magnetic dipole in the particle.

For the purposes of definition, it should be understood that the terms "time varying" and "steady" are used as relative terms in this description and imply that the rate of change of the time varying field which induces a dipole moment is much greater than the rate of change of the steady magnetic field:

$$\partial B_i/\partial t >> [B_s/\partial t$$

By independently controlling the two magnetic fields, i.e., $B_s$ and $B_i$, each of the fields can be optimized for the proper operation. For example, it is not necessary to generate a large field in order to obtain a large gradient (unless a relatively large volume is necessary or desirable.) Consequently, large, steady, gradient fields can be provided by permanent magnets, superconducting magnets or electromagnets.

In similar fashion, the coils required to provide a time varying field can be designed to match the characteristics of the power supply and need not carry large currents or be required to generate large fields. For periodic excitation of the coil, the largest values of the time variation of the field occur when the current in the coil is near zero.

One way to control the application of periodic force on a particle in the separator is to apply a periodic driving signal to the coils. The net velocity change of a particle is zero, if the time integral of the force over a time period is zero. However, as shown below, the displacement may be unidirectional. The signal supplied to coil 12 can be assymetrical in form during a particular period. That is, the signal may have an amplitude of +A and be supplied for a time period T1. Thereafter, the signal has an amplitude of −B over a time period T2. By making the magnitude of the function AT1 equal to the magnitude of the function BT2, and by making T1 plus T2 equal T (where T is the total time of a period), the magnitude of the forces related to the total impulse over a period T is zero. In addition, the average current in the coil 12 is zero. Thus it is possible that a non-linear effect in the magnetic structure can result in a net, unidirectional impulse.

Figure 2:
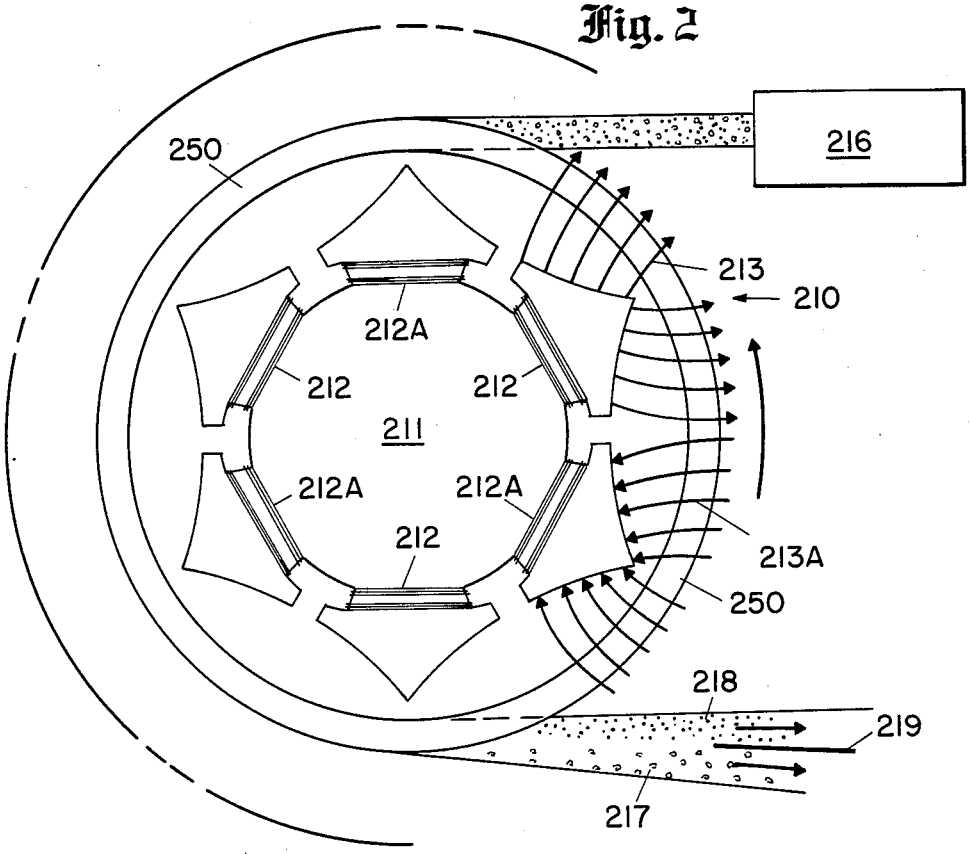
FIG. 2 is a schematic representation of another embodiment of the invention.

Referring now to FIG. 2, there is shown another embodiment of an apparatus which can be used to implement the process and method of the instant invention. The apparatus shown in FIG. 2 is related to the apparatus shown in FIG. 1 in terms of function and operation. Components which are similar in FIG. 2 have the last two digits the same as the related component in FIG. 1. The apparatus shown in FIG. 2 includes a magnetic structure which includes electromagnets, and which may also include permanent magnets. The magnetic structure 211 takes the form of a basically hexagonal configuration with slots therein for receiving coils 212 and 212A. Conversely, structure 211 may be a cylinder or may have projections extending therefrom. Of course, structure 211 is not limited to merely a hexagonal configuration.

The coils 212 and 212A are wound on alternate projections or in alternate slots of structure 211 in counter-rotation. That is, if coil 212 is wound clockwise, then coil 212A is wound counter-clockwise. In this way, the coils will produce time varying fields 213 and 213A through the projection areas of the structure 211. Of course, conversely, the coils 212 and 212A can be wound in the same direction if the signals v(t) which are supplied to the alternate coils have opposite signs or phases in order to produce time varying fields of opposite sense. The structure including the coils 212 and **212*a*, as well as the structure 211 upon which they are mounted, may be rotatable relative to the outer structure including the duct 250**.

Surrounding the magnetic structure is a duct 250 through which the materials to be separated are passed. In a preferred embodiment, the duct is wound around the magnetic structure in several revolutions and in a helical path. Thus, the mixture of materials 216 is inserted at one end of duct 250 and retrieved, in separated form, at the other end of duct 250. The separated form again comprises the conducting particles 217 and the non-conducting particles 218. These particles are sufficiently separated so as to be retrieved on opposite sides of a suitable baffle 219.

In some applications, the magnetic structure 211 can be considered to be the armature of an electric motor. In these instances, a stator 220 is provided so as to surround the mechanism shown. This arrangement provides the desirable feature of shaping the gradient magnetic field $B_s$ in the gaps between the armature 211 and the stator 220. In addition, the stator 220 provides the means for completing the magnetic circuit associated with the structure 211.

Of course, in another embodiment, the structure 211 can remain stationary. That is, by properly synchronizing the application of signals to coils 212 and 212A, a rotating field Bs is provided. By synchronizing the rotational speed of the steady magnetic field with the velocity of mixture flowing in duct 250, the efficiency of separating the conducting and nonconducting particles can be greatly improved.

Thus, in certain applications it is possible to synchronize the sign of the time varying field $B_i$ with the direction of the gradient field $B_s$ such that a unidirectional force is applied to the various particles over a complete time period. This effect may be accomplished by using a rotating armature with a rotation rate synchronized to the time varying field. Alternatively, the gradient field can be moved, electrically, by the use of appropriate field windings and phased currents. When applied to very small particles, the relative motion between the gradient field and the conducting particles can be expected to have an insignificant effect.

Figure 3:
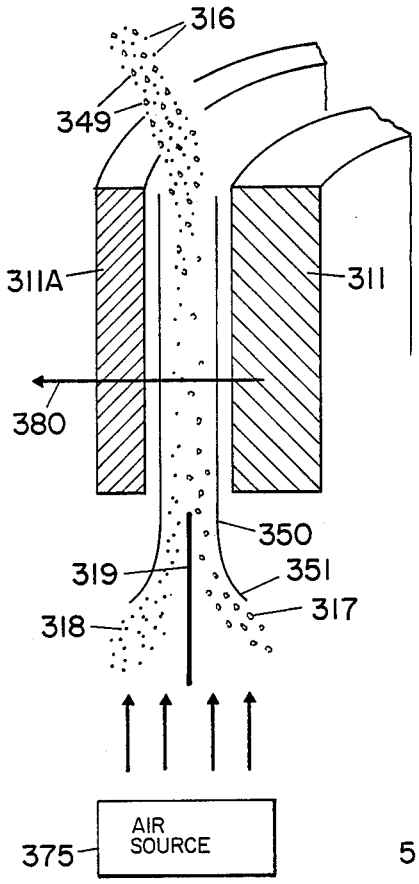
FIG. 3 is a schematic representation of another embodiment of the invention.

Referring now to FIG. 3, there is shown another apparatus arrangement which is used for providing separation of conducting and non-conducting particles. This apparatus also uses both a gradient field and a time varying field. The apparatus shown in FIG. 3 can be considered similar to the 6-pole electric rotor shown in FIG. 2. This apparatus comprises a stator which is shown as a cylindrical outer ring 311A and a rotor which is shown as an inner cylinder 311. The rotor 311 can be driven by a small electric motor (not shown) at an angular velocity. An annular (or tubular) duct 350 is disposed within the gap between rotor 311 and stator 311A. The duct 350 includes an in-feed duct 349 whereby the material to be separated is introduced into the separator. The duct 350 also includes a bell mouth 351 at the lower extremity thereof. A separator barrier 319 is disposed within or adjacent to the bell mouth 351, as shown.

A source 375 is disposed adjacent to the bell mouth 351 and adapted to provide a fluid flow (e.g. air flow) into the duct 350 via the bell mouth 351. In one embodiment of the apparatus shown in FIG. 3, the separator design requirements include a field gradient of 200 Tesla per meter and the rate of change for a time varying field of 20 Tesla per second. It is also understood that the time integrated field should not exceed 0.1 Tesla. This would correspond to a full cycle every 10 milliseconds, or a fequency of about 100 cycles per second; but sutstantially higher and lower frequencies may of course be used depending on all of the operating conditions. This implies that the time varying field must reverse direction every 5 milliseconds. The length of the separator is shown to be L.

It has been shown that small particles have small accelerating forces applied thereto by the magnetic fields. However, having the particle in free-fall while the magnetic field performs a separation is one possible way to overcome the effects of gravity on the separation technique. In order to obtain a useful separation for conductive materials such as gold particles, it is required that the particles have a dimension of approximately 15 mils and that the magnetic field act on the particle for at least one second. If the gold particle is falling in a vacuum, the separator has to be at least 4.9 meters long. However, it can be shown that the terminal velocity for a 15 mil gold particle is approximately 11.3 meters per second in air. Consequently, if source 375 produces an airstream flowing upwardly in duct 350 with a velocity of 11.3 meters per second, the particle would appear to be stationary in space and a greatly enlarged time period is provided to effect the separation. Of course, larger particles would move downwardly more rapidly than the small particles. However, in this case the downward velocity of the larger particles would generally not be prohibitive. Moreover, the velocity of the larger particles tends to increase almost linearly as a function of the diameter of the particle while the magnetic forces operating on the particle tend to increase as a square of the diameter of the particle.

In the apparatus shown in FIG. 3, one typical arrangement includes a gap spacing of approximately 2 centimeters between the rotor and stator in order to produce the necessary field gradient without requiring an excessive value of $B_s$. Within this gap, the steady magnetic field changes direction approximately every 5.4 milliseconds when the rotor is turning at a speed of 1800 rpm. Of course, additional coils, in either the rotor or the stator, can produce the time varying field $B_i$ and change the sign of the time derivative in synchronization with $B_s$.

In the operation of the apparatus shown in FIG. 3, the particle mixture 316 is introduced into the feed duct 349. The mixture 316 enters the duct 350 with a velocity $V_0$ through an opening in duct 349 which has a width referred to as the "throat dimension" $D_t$.

The mixture enters the main duct 350 through which there is an air flow in the opposite direction with the velocity of $V_a$. As the mixture falls through duct 350 in opposition to the counterflow of fluid provided by air source 375, the mixture is subjected to the radial magnetic field $B_s$ and $B_i$ as shown by the arrow 380. The mixture is separated into two streams by the magnetic fields in accordance with the techniques described above and these particle streams are kept separated by splitter 319. Once the particles are separated, they can be settled out in separate receptacles (not shown).

It is noted that the bell mouth 351 provides both a smooth transition of the air into the annular duct 350 and also reduces the counterflow velocity of the air after the separation has been effected. Also, the bell mouth can reduce air turbulence and, through the smooth transition, permit a substantially laminar flow of fluid upwardly through the duct 350.

Figure 4:
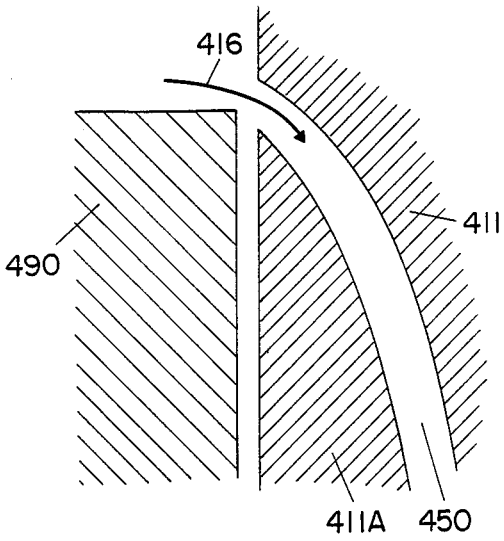
FIG. 4 is a schematic representation of one duct configuration useful with the invention.

Referring now to FIG. 4, there is shown a cross section of a parabolically shaped duct in a magnetic separator of the type described above. For convenience, many of the details of the separator are omitted in this Figure. Basically, the apparatus includes the magnetic components 411 and 411A which can be separate elements or, alternatively, part of a unitary body. However the magnetic structures 411 and 411A assist in providing the magnetic fields $B_s$ and $B_i$ which have been described above. The duct 450 passes between the magnetic elements 411 and 411A. The duct 450 may be a separate tubular arrangement or it can be formed by the sides or edges of the components 411 and 411A, respectively. The duct 450 is depicted to have a parabolic configuration and a uniform opening shape and dimension. However, it is possible for duct 450 to have a smoothly varying (e.g. widening) shape and dimension.

Not shown in all of the preceding Figures is a schematic representation of a conveyor 490 or other similar mixture transport mechanism. The mixture 416 is disposed on the conveyor 490 and deposited into the mouth of the duct 450. In this apparatus, the mixture is deposited by the conveyor 490 and enters the separator duct with a horizontal velocity component. As the material passes through duct 450 it is in a "free-fall condition" and subjected to the magnetic fields produced by the magnetic structure elements 411 and 411A. This arrangement tends to keep the materials in the "free-fall condition" for a somewhat longer period of time. As shown here, the constant cross-section duct is appropriate when the path of the particle is not significantly affected by viscous forces.

Figure 5:
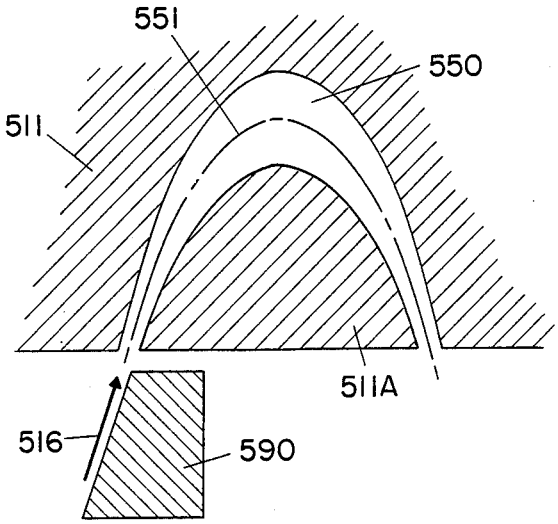
FIG. 5 is a schematic representation of another duct configuration useful with the invention.

Referring now to FIG. 5, there is shown a variation on the apparatus shown in FIG. 4. The apparatus of FIG. 5 is a cross-section of a duct which is parabolically curved and which has a variable area therein. This variation is particularly suitable when viscous forces are significant or predominate. Then the velocity of the particle along the axis is very nearly that of the local fluid (air, water, etc.) in which it is immersed. As governed by the equation of continuity, the velocity of the fluid is inversely proportional to the cross-sectional area of the duct. Thus, the velocity profile through the duct could be made the same as the particle would have if it were in free fall in a vacuum.

In particular, a suitable transport mechanism 590 is used to project the mixture 516 into the parabolic, variable area duct 550. The mixture tends to follow the parabolic path of the center line of the duct which is indicated by the dashed line 551. The structure comprises the magnetic elements 511 and 511A which are similar to the portions of the magnetic structure which are described above. These magnetic structure elements, together with any coils or the like, are used to provide magnetic fields $B_s$ and $B_i$. Again, the operation of this apparatus is fully described in conjunction with the basic apparatus shown and described above but permits the particles to be in the "free-fall condition" somewhat longer so as to be subjected to the magnetic field operation for purposes of separation.

DISCUSSION OF THEORY

The various types of apparatus which are shown and described above are illustrative types of apparatus and suggested configurations which will permit the separation of conductive materials from non-conductive materials. This technique has, as one application, the separation of gold from other aggregate in order to retrieve the gold or other conductive material. Conversely, in some applications, the conductive material is to be considered the "contaminant" which should be removed. In either event, the apparatus shown and described herein will perform the desired function.

In describing the theory of the operation, certain calculations, assumptions and derivations are necessary and/or desirable. For example, in considering the acceleration of a conductive particle, the force exerted on a particle by a magnetic field is given by the product of the particle's magnetic dipole moment and the gradient of the magnetic field at the location of the particle. For a conducting substance such as gold, which has neither a permanent magnetic dipole moment nor a sensible magnetic susceptibility, it is possible to induce a magnetic dipole moment, p, by exposing the gold to a time varying magnetic field. The force, F, exerted on the gold particle is given by $$F=\rho\cdot\nabla B \tag{1}$$

$$p=p(R,\ \sigma,\ \partial B/\partial t)$$

where

R=an effective radius of a particle $\sigma$=conductivity

The acceleration is given by the force divided by mass of the particle $$a=F/m=F/\rho v=(\rho/\rho v)\cdot\nabla B$$

or $$a=\gamma(\sigma/\rho)R^2(\partial B/\partial t)\cdot\nabla B \tag{2}$$

$\gamma$=constant depending on shape $\rho$=density

V=volume

The constant, $\gamma$, is relatively insensitive to the shape of the particles and varies about 30% between a sphere and a thin disk. The ratio of the material bulk properties $\sigma/\rho$, shows that gold will have about 1/6 the acceleration of an equivalent aluminum particle and about $\frac{1}{3}$ the acceleration of copper or silver.

It is easily shown that a periodic force with an avarage value of zero can result in a non-zero displacement. For ease of integrating the equations of motion, it is assumed that the acceleration has a symmetrical profile, and has a period, T. For simplicity, the initial conditions on displacement, x, and velocity, v are assumed to be:

$$x(0)=v(0)=0 \tag{3}$$

The one dimensional equations of motion are:

$$d^2x/dt^2=a_o;\ 0<t\leqq T/2 \tag{4a}$$

$$d^2x/dt^2=-a_o;\ T/2<t\leqq T \tag{4b}$$

Integrating equation (4a) to obtain velocity provides:

$$dx/dt=v(t)=a_0t+c_1;\ 0<t\leqq T/2 \tag{5a}$$

because v (0)=0; $c_1=0$; and $v(T/2)=a_0T/2$

For the second half of the period $$dx/dt=v(t)=-a_0t+c_1';\ T/2<t\leqq T$$

because $$v(T/2)=a_0(T/2),\ c_1'=a_0T;$$

and $$v(t)=a_0(T-t);\ T/2<t\leqq T$$

As expected, v(T)=0 due to the periodic acceleration.

Integrating again to determine displacement, $$x(t)=\tfrac{1}{2}a_0t^2+c_2;\ 0<t\leqq T/2 \tag{6a}$$

Because x(0)=0, $c_2=0$ and $x(T/2)=(a_0/8)T^2$

Finally, integrating Eq. (5b) provides $$x(t)=-(a_0/2)t^2+c_2'+a_0Tt$$

or $$x(t)=a_0T(t-T/4)-\tfrac{1}{2}a_0t^2;\ (T/2)<t\leqq T \tag{6b}$$

At the end of the period, T, the particle has moved to $x(T)=(a_0/4)T^2$, or one half the distance it would have been displaced had the acceleration beeh unidirectional. The calculations of displacement and drop include the effects of air resistance on the motion of the particle. The equation describing the motion is:

$$m(d^2x/dt^2)+k(dx/dt)+kv_a=mg \tag{7}$$

The terms in Eq. 7 have the previously defined meanings. The coefficient, k, is the proportionality constant for the viscous force. Rearranging terms, provides:

$$(d^2x/dt^2)+(k/m)(dx/dt)=g-(k/m)v_a=g' \tag{8}$$

The quantity k/m can easily be calculated from the terminal velocity formulas given in standard handbooks. Integrating Eq. 8, provides the distance and velocity equations:

$$x(t) = X_i + \frac{m}{k}\left[N_o\left(1 - e^{-\frac{k}{m}t}\right) + g't\right] - \left(\frac{m}{k}\right)^2 g'\left(1 - e^{-\frac{k}{m}t}\right) \tag{9}$$

-continued $$N(t) = N_o e^{-\frac{k}{m}t} + \frac{m}{k}g'\left(1 - e^{-\frac{k}{m}t}\right) \tag{10}$$

When using Eq. (9) and (10) to calculate the effect of the magnetic fields, the acceleration, "a" Eq. (2), is substituted for g'.

Within the previously stated constraints relative to FIG. 3, the production rate depends on the size of the apparatus and on the quality of the ore. The concentration of gold in commercial grade ore ranges from 5 to 25 grams/ton. Since crushed ore weighs approximately 3200 pounds per cubic yard, an ore that has 5 grams of gold per ton, has 9.512 grams per cubic meter. This figure for a marginal grade ore is used in realistic production calculations. In a typical example, the diameter of a suitable rotor is defined to be 0.6 m and the width of the air gap 0.02 m. Similarly, the length, L, of the structure 1.4 m, the width, Dt, of the exit plane of the feed duct 349 is 0.0025 m, and the circumference of duct 349 at the exit plane is approximately 2 m. If the feed rate of ore into duct 349 is such that $v_o=0.5$ m/sec, then the flow rate through the apparatus is 0.0025 cu. m/sec or 9 cu. m/hr. Assuming 100% recovery, this would result in 2.75 troy oz./hr. In one year's time (assuming 50 five-day weeks) the apparatus would recover 5500 troy oz. of gold.

Calculations were made on the amount of separation that would be produced on gold particles of various diameters, and for coarse silver and copper particles, for the magnetic fields recited above. The amount of separation is shown in Table I under the column labeled DISPL (displacement). As can be seen, the displacements exceed the size of the apparatus for the larger particles. That is because it is assumed in the calculations that the magnetic field parameters were constant over all space. Hence, the displacement is proportional to the exposure time. In actual practice, the larger particles hit the inner wall of duct 350, and simply fall straight down. As can be seen for 34 mil gold, 0.5 second acceleration by the magnetic fields is sufficient to produce adequate separation. The distance different size particles fall with and without a counter-flow is also shown. The counter-flow velocity was 11.267 m/sec, the terminal velocity of 15 mil gold. The distance a particle falls is also dependent upon the initial velocity, $v_o$, at the exit plane of feed duct 349. It can be seen from Table I that the length of the apparatus, L, need not be greater than 1.4 m for an initial velocity, $v_o$, of 0.5 m/sec with counter-flow.

TABLE I

DISTANCE A PARTICLE WILL DROP IN A COUNTER-FLOW FOR VARIOUS INITIAL CONDITIONS

| | | | | DROP (m) | | | | | |
|---|---|---|---|---|---|---|---|---|---|
| | | | | $v_a$ = 11.267 m/s | | | $v_1$ = 0 | | |
| SUBST | DIAM (mils) | TIME(s) | DISPL(cm) | $v_o$ = 0 | 0.5 m/s | 1.0 m/s | 0 | 0.5 | 1.0 |
| FINE | | | | | | | | | |
| Au | 15 | 1.00 | 1.177 | 0 | 0.333 | 0.667 | 3.741 | 4.075 | 4.409 |
| Au | 20 | 1.00 | 2.231 | 0.994 | 1.361 | 1.728 | 3.987 | 4.354 | 4.721 |
| Au | 34 | 1.00 | 6.998 | 2.418 | 2.833 | 3.248 | 4.329 | 4.744 | 5.159 |
| MEDIUM | | | | | | | | | |
| Au | 34 | 0.50 | 1.860 | 0.642 | 0.870 | 1.097 | 1.150 | 1.378 | 1.605 |

TABLE I-continued

| DISTANCE A PARTICLE WILL DROP IN A COUNTER-FLOW FOR VARIOUS INITIAL CONDITIONS | | | | | | | | | |
|---|---|---|---|---|---|---|---|---|---|
| | | | | DROP (m) | | | | | |
| | DIAM | | | $v_a$ = 11.267 m/s | | | $v_1$ = 0 | | |
| SUBST | (mils) | TIME(s) | DISPL(cm) | $v_o$ = 0 | 0.5 m/s | 1.0 m/s | 0 | 0.5 | 1.0 |
| Au | 74 | 0.50 | 9.060 | 0.896 | 1.133 | 1.371 | 1.183 | 1.420 | 1.658 |
| COARSE | | | | | | | | | |
| Au | 74 | 0.25 | 2.305 | 0.228 | 0.350 | 0.471 | 0.301 | 0.423 | 0.544 |
| Au | 100 | 0.25 | 4.219 | 0.239 | 0.361 | 0.483 | 0.302 | 0.424 | 0.546 |
| Ag | 100 | 0.25 | 11.552 | 0.215 | 0.336 | 0.458 | 0.300 | 0.421 | 0.543 |
| Cu | 100 | 0.25 | 12.822 | 0.208 | 0.329 | 0.449 | 0.300 | 0.420 | 0.541 |
| Cu | 100 | 0.10 | 2.079 | 0.034 | 0.083 | 0.132 | 0.049 | 0.098 | 0.147 |

Figure 6:
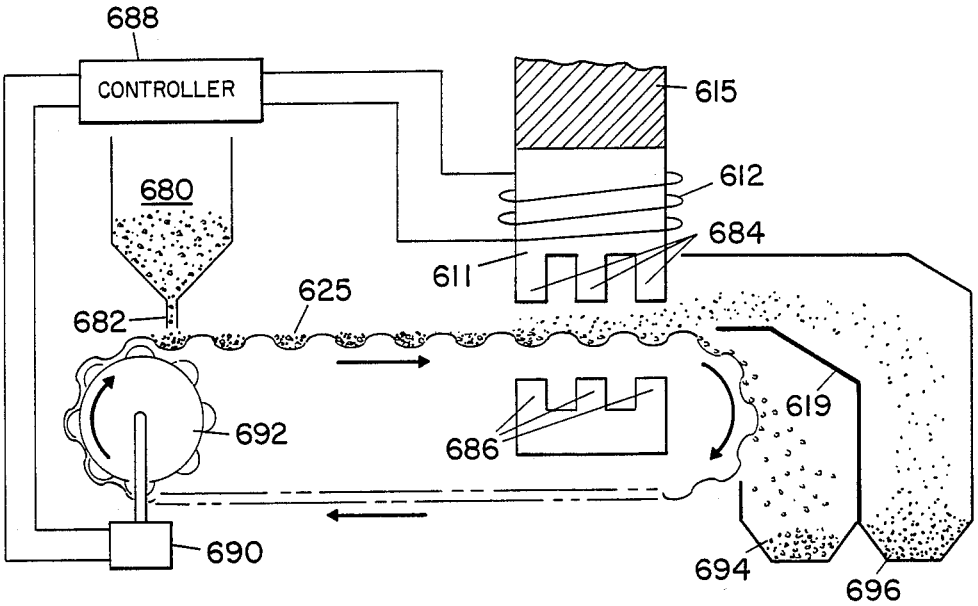
FIG. 6 represents another embodiment of the invention, with special synchronization arrangements for improving separation.

FIG. 6 shows another alternative arrangement for implementing the principles of the invention. More specifically, in FIG. 6, the conveyor belt 625 has a rippled configuration, so that, when the particulate material, including some gold or other conductive particles, are fed from hopper 680 in a fine stream 682, the bulk of the particles will settle in the recesses in the outer surface of the belt.

Now, as mentioned above, it is desirable, for maximum displacement that the particles be subject to a rate of change of flux of one polarity only from the alternating magnetic field $B_i$ while in the steady magnetic field $B_s$.

Using a constant magnetic field $B_s$, and a varying magnetic field of 500 hertz, or 500 cycles per second a speed for the conveyor belt of 10 meters per second is employed. During one cycle, therefore, the belt will move two centimeters. With the depressions on the outer surface of the belt being centered two centimeters apart, and the pole pieces 684 and 686 being one centimeter wide and one centimeter apart, the belt 625 and the coils 612 are now driven in phase synchronism. This is accomplished by the controller 688 driving the special motor 690 to control the gear 692 which has outer teeth which engage lugs and recesses on the inner surface of the flexible belt 625. The energization of the coils 612 and the spacing of the pole pieces 684 and 686 are such that the induced dipoles in the conducting material always have the same polarity; and that, as the particulate material is moving between pole pieces, and the bulges in the belt are between the pole pieces, the polarity of the change in flux is reversed. Then, when the particulate material is moved between the next pair of opposed pole pieces and the polarity of the change in magnetic flux reverses again, the particulate material is deflected further away from the belt above the septum 619. Accordingly, non-conductive material is collected in receptacle 694 and conductive material in receptacle 696. It is to be understood, of course, that different conveyor speeds, pole piece spacings, and frequency of the alternating field may be employed to accomodate different types of material and other conditions.

CONCLUSION

Thus, there is shown and described an apparatus which is especially useful for separating conductive materials from non-conductive materials through the means of improved magnetic separation. The apparatus produces an improved separating process by permitting independent control of time varying and gradient magnetic fields, application of periodic force to the materials being separated, a time varying current which has an average value of zero to produce the time varying magnetic field, and providing a net displacement of the conductive materials being separated from the non-conductive materials by a combination of the steady and varying magnetic fields.

By independently controlling the two fields, each can be optimized for the required job.

By using a periodic driving function or force, the particles can be exposed for relatively long times without the need for large values of current in the coils or large magnitudes of the time varying field. By applying forces to the particles in asymetrical manner, the velocity dependent forces on particles can be overcome in order to maximize the displacement of the particle over the particular cycle.

By synchronizing the sign of the time varying field with the direction of the gradient field, a unidirectional force is applied to the particles over a complete period, or over several cycles. All of the above steps may be utilized to maximize the separation of the conductive and non-conductive particles with a minimization of the time and energy requirements.

As noted, the types of apparatus shown and described are illustrative only. It is clear that modification can be made to the structures shown and described. However, any such modifications which fall under the purview of this invention are intended to be included therein as well. For example, the parabolic ducts can be of variable area or constant area. The number of poles in the "electric motor" apparatus can be six or some other suitable number. In some configurations, arrangements may be provided to collect conductive particles displaced in both directions relative to the nonconductive material, with the direction of displacement being a function of the time of entry of the conductive particles into the varying magnetic field. It is to be understood, therefore, that the present invention is not limited to the particular embodiments shown in the drawings or as discussed in the foregoing detailed description.

What is claimed is:

1. A separator apparatus for separating conductive material from nonconductive material, comprising, a supply of conductive and nonconductive particulate material with neither type of material being magnetic material;

means for moving conductive and non-conductive material from said supply through a predetermined zone;

first magnetic means for producing a gradient field in a predetermined direction across said predetermined zone; and second magnetic means for producing a rapidly time varying magnetic field having at least a substantial component aligned with said gradient field across said zone to induce magnetic dipoles in said conductive material to shift the position of the conductive material relative to the non-conductive material and thereby separate the two types of material.

2. The separator recited in claim 1 wherein,
said first magnetic means comprises permanent magnetic means for producing a steady gradient field.

3. The separator recited in claim 2 wherein,
said permanent magnetic means includes at least a pair of opposite magnetic poles arranged adjacent to each other.

4. The separator recited in claim 1 wherein,
said second magnetic means includes at least one coil for producing a varying magnetic field in response to a signal supplied thereto.

5. The separator recited in claim 1 wherein,
said first and second magnetic means are combined in a single component.

6. The separator recited in claim 1 including,
duct means for guiding said conductive material and said nonconductive material through said zone.

7. The separator recited in claim 6 including,
flow means for producing a fluid flow in said duct means in the opposite direction to the conductive and nonconductive material passing through said zone.

8. The separator recited in claim 6 wherein,
said duct member is disposed vertically relative to said first magnetic means and said second magnetic means so that said conductive material and said nonconductive material pass therethrough in free fall.

9. A separator as defined in claim 1 including means for subjecting the conductive materials to be separated to magnetic forces acting on said conductive material primarily in a single direction.

10. A separator as defined in claim 1 including means for supplying the material to be separated in spaced increments of material.

11. A separator as defined in claim 1 wherein said means for applying magnetic fields to said zone includes a plurality of spaced pole pieces.

12. A separator apparatus for separating electrically conductive material from electrically nonconductive material comprising:
a supply of conductive and nonconductive particulate material with neither type of material being magnetic material;
means for moving said material;
means for inducing magnetic dipoles in said electrically conductive materials in a predetermined zone as they are being moved; and
means for applying a relatively steady magnetic field to said dipoles in the same predetermined zone to selectively exert a magnetic force against the electrically conductive materials so that said conductive materials are displaced relative to said nonconductive materials.

13. The separator recited in claim 12 wherein,
said means for inducing comprises a relatively high frequency magnetic field source aligned with said steady magnetic field means.

14. The separator recited in claim 12 wherein,
said means for applying comprises a relatively steady magnetic field source.

15. A method of separating electrically conductive material from electrically nonconductive material where neither type of material is magnetic material, comprising the steps of:
supplying a mixture of non-magnetic conductive material and non-magnetic nonconductive material to a work station;
applying a relatively high frequency magnetic field in a predetermined direction to said mixture in a predetermined zone at said work station thereby to create magnetic dipoles on said electrically conductive material;
applying a relatively steady magnetic field to said mixture in said predetermined zone with at least a substantial component of said magnetic field being oriented in the same predetermined direction, thereby to create a magnetic force on the conductive materials which are magnetic dipoles to displace said conductive material; and
providing means for segregating the electrically conductive materials from the electrically nonconductive materials.

16. A separator apparatus for separating conductive material from nonconductive material, comprising,
a supply of conductive and nonconductive particulate material with neither type of material being magnetic material;
means for moving conductive and nonconductive material from said supply through a predetermined zone;
first magnetic means for producing a gradient field in a predetermined direction across said predetermined zone;
said first magnetic means comprising permanent magnetic means for producing a steady gradient field; and said permanent magnetic means including at least a pair of opposite magnetic poles arranged adjacent to each other;
second magnetic means for producing a rapidly time varying magnetic field having at least a substantial component aligned with said gradient field across said zone to induce magnetic dipoles in said conductive material to shift the position of the conductive material relative to the nonconductive material and thereby separate the two types of material; and
said pair of opposite magnetic poles forming stator and rotor elements.

17. The separator recited in claim 16 wherein,
coils are provided on at least one of said stator and rotor elements to produce a time varying magnetic field.

18. A separator apparatus for separating conductive material from nonconductive material, comprising,
a supply of conductive and nonconductive particulate material with neither type of material being magnetic material;
means for moving conductive and nonconductive material from said supply through a predetermined zone;
first magnetic means for producing a gradient field in a predetermined direction across said predetermined zone;
second magnetic means for producing a rapidly time varying magnetic field having at least a substantial component aligned with said gradient field across said zone to induce magnetic dipoles in said conductive material to shift the position of the conductive material relative to the nonconductive material and thereby separate the two types of material; and
duct means having a parabolic configuration for carrying said conductive material and said nonconductive material through said zone.

19. A separator apparatus for separatine conductive material from nonconductive material, comprising, a supply of conductive and nonconductive particulate material with neither type of material being magnetic material;

means for moving conductive and nonconductive material from said supply through a predetermined zone;

first magnetic means for producing a gradient field in a predetermined direction across said predetermined zone;

second magnetic means for producing a rapidly time varying magnetic field having at least a substantial component aligned with said gradient field across said zone to induce magnetic dipoles in said conductive material to shift the position of the conductive material relative to the nonconductive material and thereby separate the two types of material; and means for synchronozing the flow of materials with the applied magnetic fields to exert accelerating forces on said conductive material, acting principally in a single direction.

* * * * *